United States Patent [19]

Suga

[11] Patent Number: 5,004,235

[45] Date of Patent: Apr. 2, 1991

[54] SURFACE UNIT ON PERIPHERAL WALL OF TENNIS COURT FIELD

[76] Inventor: Tamio Suga, 8-99, Tokiwa Muranouchicho, Ukyo-ku, Kyoto-shi, Kyoto, 615, Japan

[21] Appl. No.: 283,328

[22] PCT Filed: Jan. 8, 1988

[86] PCT No.: PCT/JP88/00017

§ 371 Date: Dec. 6, 1988

§ 102(e) Date: Dec. 6, 1988

[87] PCT Pub. No.: WO89/06151

PCT Pub. Date: Jul. 13, 1989

[51] Int. Cl.[5] ..... A63B 61/00

[52] U.S. Cl. ..... 273/29 A; 273/30

[58] Field of Search ..... 273/29 R, 29 A, 30

[56] References Cited

U.S. PATENT DOCUMENTS

| | | | |
|---|---|---|---|
| 3,968,967 | 7/1976 | Nally | 273/29 A |
| 4,026,551 | 5/1977 | Larson | 273/29 A |
| 4,491,321 | 1/1985 | Veenema | 273/29 A |

FOREIGN PATENT DOCUMENTS

| | | | |
|---|---|---|---|
| 81174 | 6/1983 | Fed. Rep. of Germany | 273/29 A |
| 2098829 | 10/1972 | France | 273/29 A |
| 1592757 | 7/1981 | United Kingdom | 273/29 A |

*Primary Examiner*—Theatrice Brown

*Attorney, Agent, or Firm*—Lowe, Price, LeBlanc, Becker & Shur

[57] ABSTRACT

The invention provides a surface unit, to be mounted on the surface of a peripheral wall of a tennis court field having a plurality of tennis courts without partition between one court and the other, to prevent a tennis ball that impacts onto the wall rearward of the back line from rebounding into an adjacent court. The tennis ball thus rebounds with a reduced velocity, back to the original court where a game is going on. The surface unit comprises a plurality of repelling members of rebound-reducing material each formed into elongated triangular-sectioned elements, preferably of isosceles cross-section, the plurality of repelling members being installed in parallel on a surface of a peripheral wall of a tennis court field so that the longitudinal direction of each repelling member extends vertically. The flat sides of the members, opposed to ridge lines formed by joining the other two sides of the repelling member, are held at the surface of the peripheral wall either directly or through a sheet member. The distance between one ridge line and the other in the repelling members adjacent to each other is established so as to be equal to or not shorter than the diameter of a tennis ball.

10 Claims, 3 Drawing Sheets

SURFACE UNIT ON PERIPHERAL WALL OF TENNIS COURT FIELD

TECHNICAL FIELD OF THE INVENTION

The present invention relates to a surface unit on peripheral wall of tennis court field, the surface unit being mounted on a peripheral wall installed around a tennis court for reducing rebound of a tennis ball sent over to the peripheral wall and returning the ball back conveniently toward the tennis court.

BACKGROUND ART

Generally, a tennis court area is surrounded with a peripheral wall and a plurality of tennis courts are arranged therein just by drawing lines, and it is conventional that there is no partition wall serving as a boundary between one tennis court and another adjacent to it. It is also conventional that a wire-netting fence is provided at the portion rearward of the back line of each tennis court, and in which a sheet is stretched over the court side of the fence up to about 1 m above the ground, whereby a part of the wire-netting fence up to that height is covered with the sheet.

There is also another type of tennis court field constructed in such a manner that a concrete or wooden wall is built up rearward of the back line of each tennis court up to about 1 m above the ground, and a wire-netting fence is further installed on the wall.

When the wall located rearward of the back line of the tennis court is made of fully stretched sheet or hard material such as concrete as mentioned above, a tennis ball typically rebounds strongly without reduction of rebounding force after impact against the surface of the wall located rearward of the back line. If such a strong rebound of tennis ball takes place just at the rear of the back line, the ball may conveniently return back near to the player. However, if the ball is sent obliquely to either side of the wall rearward of the back line and runs into such a side, the ball will rebound toward the adjacent tennis court because there is no partition between the tennis courts adjacent to each other. As a result of this, the players on the adjacent court are obliged to interrupt the game to pick up the ball, and. Moreover the play going on in the adjacent court is also obliged to be interrupted when the tennis ball comes running in the adjacent court or service area thereof. If such an interruption occurs frequently, interest in the game itself may be lost. There is a further possibility that a player may accidentally tread on the tennis ball coming from the other court and fall down violently to be injured.

Hence, an object of the present invention is to provide a surface unit on a peripheral wall of a tennis court field having a plurality of tennis courts without partition between one court and the other, by which it is a tennis ball, moving obliquely over to either side of the surface of the wall rearward of the back line and impacting on it, has a reduced tendency to enter the adjacent court, and by which the tennis ball rebounds conveniently back to the original court where a game is going on.

SUMMARY OF THE INVENTION

To accomplish the foregoing object of the present invention, a plurality of repelling (rebounding) members of rebound-reducing material are formed into elongated triangular poles of isosceles triangle shape in cross section, and are installed on a peripheral wall of the tennis court field, in such a manner that the longitudinal direction of each repelling member extends vertically. The sides opposed to ridge lines each formed by joining the other two sides of each repelling member are brought into contact with the surface of the wall either directly or through a sheet member.

In one aspect of the invention, a distance between one ridge line and the other in the repelling members adjacent to each other is selected to be not less than the diameter of tennis ball. Thus, a rebound-reducing surface unit on peripheral wall of tennis court field is achieved.

The surface unit of above construction is installed on a section between the parts rearward of each back line of the tennis courts adjacent to each other in the peripheral wall of the tennis court field, for example. Accordingly, a tennis ball sent over to the surface member runs into any of the sides facing to the tennis court where the play is going on among those sides formed on the triangular pole of isosceles triangle in cross-section and conveniently rebounds, coming back to the tennis court where the play is going on. At the moment when the tennis ball runs against the side of the repelling member, the rebounding force of the ball is appropriately reduced since the repelling member is made of a material selected for reducing the rebounding force of the ball. Furthermore, player is protected from injury if he should run into the surface unit since the repelling member thereof is made of such a rebound-reducing material.

The surface unit of above construction and function according to the invention can be placed on any section of the peripheral wall of a tennis court field having plural tennis courts, whereby a majority of the rebounds that would otherwise send the ball toward the adjacent court after colliding with the surface of the wall located rearward of back line of each tennis court can be reduced without partition between the tennis courts adjacent to each other. Accordingly, players are spared the trouble of going to the adjacent court for picking balls. Furthermore, a player can be served from an accident such as treading on the ball coming from the adjacent court and falling down. As a result, a player can devote himself more to the play and enjoy it.

BRIEF DESCRIPTION OF THE DRAWINGS

FIGS. 5-1 and 5-2 are schematic plan views for explanation of how a tennis ball is incident on the surface unit according to the invention and rebound therefrom.

DESCRIPTION OF THE PREFERRED EMBODIMENTS

Described herainafter with reference to the accompanying drawings are preferred embodiments according to the present invention.

Figure 1:
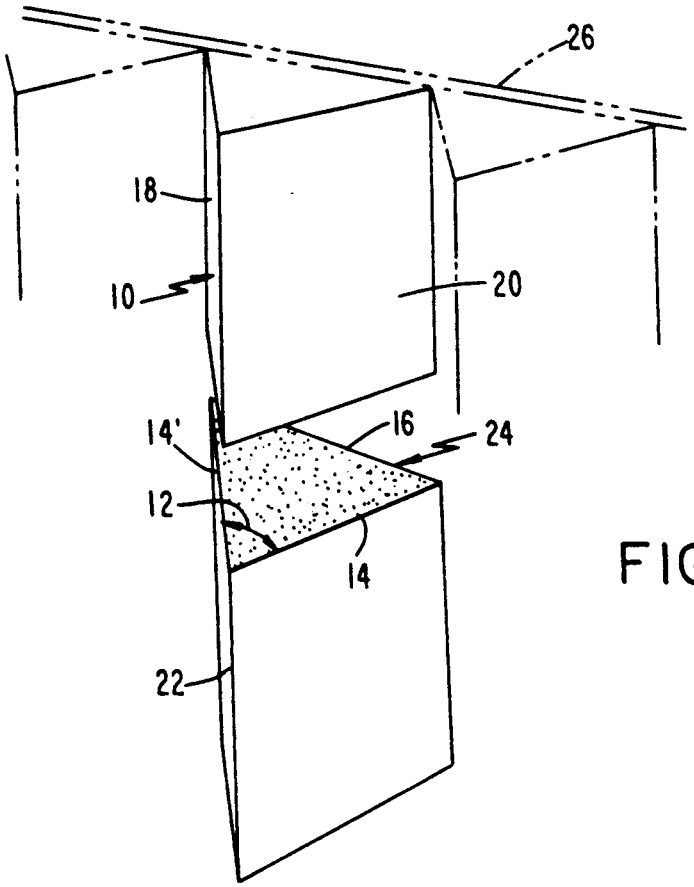
FIG. 1 is a partially exploded perspective view illustrating a surface unit on peripheral wall of a tennis court field according to a preferred embodiment of the present invention.

FIG. 1 is a partially exploded perspective view illustrating a surface unit mounted to a peripheral wall of tennis court field, according to one embodiment of the invention. In the drawing, the repelling member 10 forming a main body of the surface unit is made of a rebound-reducing material, i.e., a hard sponge-type material such as foam polyethylene, and is formed into an elongated triangular cross-section pole. The exemplary repelling member 10 is an isosceles triangle in cross-section, and vertical angle 12 of the isosceles triangle, formed between two elongate sides 14, 14' of equal length, is almost a right angle. The length of base 16 opposed to the vertical angle 12, i.e., a distance between the vertical angles of the repelling members 10 adjacent to each other in the arrangement illustrated in the FIG. 1 is equal to or not less than the diameter of the tennis ball. Exemplary dimensions of respective sections of the repelling member 10, length of each side 14, 14' in cross-section 16 cm, length of the base 16 22.6 cm, height from middle point of the base to vertical angle, i.e., thickness of the repelling member 10 11.3 cm, and full length (height) 1 m. Among the three sides of the repelling member 10, two sides whose areas are equal form a first collision surface 18 and a second collision surface 19 respectively, and a remaining side facing to the ridge line formed between the first and second collision surfaces forms a mounting face 24. The mounting face 24 is then adhesively fixed to the sheet member 26 indicated by two-dot-chain line, and after installing a plurality of repelling members 10 in parallel to one another, the sheet member 26 is attached to the concrete wall surface. In an alternative the mounting face 24 is directly adhered to the concrete wall surface, whereby plural repelling members 10 are continuously mounted on the concrete wall surface. The sheet member 26 is made of a sponge plate of 2 cm in thickness composed of a material such as a hard sponge which is the same material as the repelling members 10 or, alternatives a polypropylene plate of about 3 mm thickness.

In addition, the main body of the repelling member can be made of a hard sponge and the surface is covered with a leather. It is also preferable that the repelling members adjacent to each other are arranged in parallel with some distance therebetween. In such a construction, length of the base of each repelling member in cross-section is not equal to the distance between two vertical angles of the adjacent repelling members but shorter than it.

Figure 2:
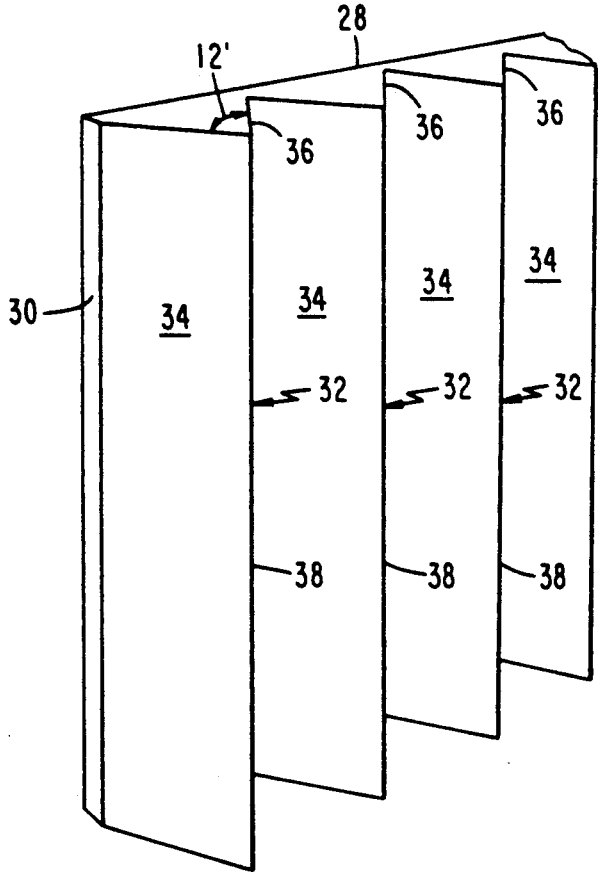
FIG. 2 is a perspective view illustrating a surface unit according to another embodiment.

FIG. 2 is a perspective view illustrating another embodiment of the invention. In the surface unit of this embodiment, the repelling members and the sheet member in the foregoing embodiment referring to FIG. 1 are solidly formed as one surface unit. More specifically, in this surface unit, a plurality of triangular poles 32, each of whose vertical angle 12' is almost a right angle and having first collision surface 34 and the second collision surface 36, are projectingly arranged in parallel on one side of the base section 30 whose other side serves as a mounting face 28, in such a manner that a space between each ridge line 38 formed by the first and second collision surfaces 34, 36 is larger than the diameter of tennis ball. The plural repelling members are solidly formed of a hard sponge.

Figure 3:
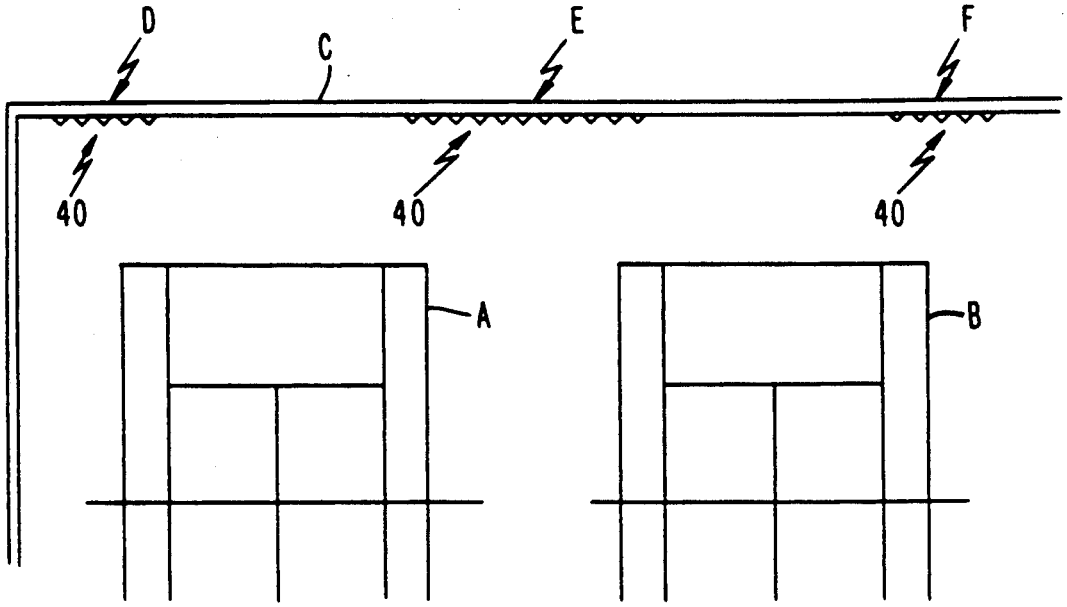
FIG. 3 is a partial plan view illustrating surface units according to the invention attached onto the wall located rearward of two tennis courts arranged in parallel within a tennis field.
Figure 4:
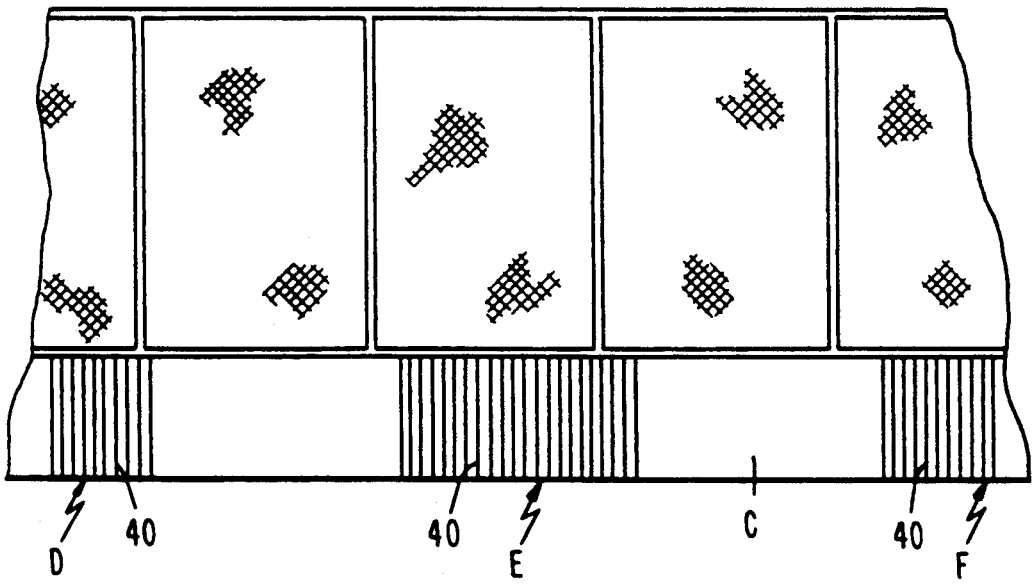
FIG. 4 is a front view of the surface units; per FIG. 3.

FIG. 3 is a partial plan view illustrating surface units according to the invention attached onto the wall located rearward of the tennis courts arranged in parallel, and FIG. 4 is a front elevation view thereof.

As seen from the drawings, the surface units 40 of above construction are respectively mounted at specified positions on the surface of a peripheral wall located rearward of back lines of the tennis courts A, B arranged in parallel and formed of a wire net N in the upper part and a concrete wall C in the lower part, i.g., at positions D, E, F located rearward of both sides of the tennis courts A, B over 4 to 8 m in width at the position D and 8 to 10 m in width at the position E, for example, establishing the longitudinal direction of the repelling members as vertical direction.

Figures 1, 5:
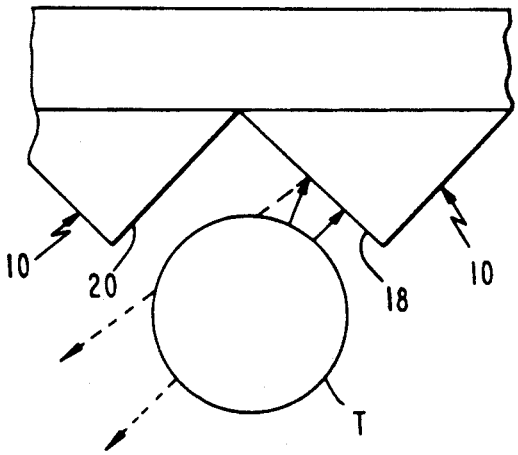
Figures 2, 5:
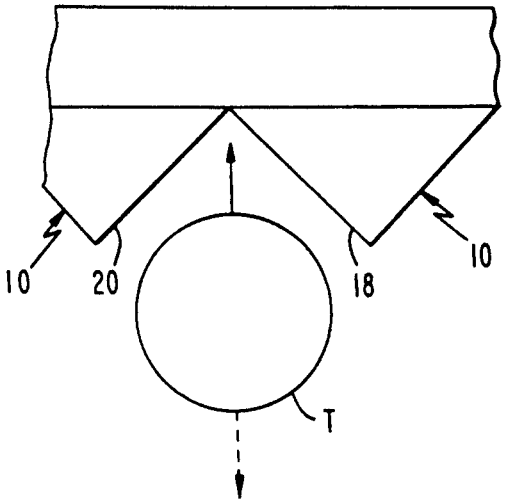

Supposing that a game is going on at the tennis court A for example, a tennis ball sent over to the position E located rearward of the right side of the back line of the tennis court A in the drawing runs against the first collision surface 18 of the repelling member 10 of the surface unit facing to the tennis court A, with a certain angle as indicated by the solid arrow, and then rebounds in the direction indicated by the dotted arrow with its rebounding force adecuately reduced, whereby the tennis ball T comes back to the tennis court A, as illustrated in FIG. 5-1.

In the same manner, if the tennis ball T is sent over to the position D located rearward of the right side of the back line of the tennis court A in FIG. 3 when a game is going on at the tennis court A, the ball T runs against the second collision surface 20 also with a certain angle, the collision surface 20 facing to the tennis court A, and then rebounds back to the tennis court A, though not illustrated. The foregoing function can be achieved likewise when the tennis ball runs against the position E or F located rearward of the left or right side of the back line of the tennis court B.

Referring to FIG. 5-2, when the tennis ball is sent to the intermediate position between the two repelling members 10 adjacent to each other and runs into both first collision surface 18 and second collision surface 20 of the respective repelling members as indicated by the solid line, the ball rebounds in the direction indicated by the dotted arrow. Accordingly, in this case also, the tennis ball does not rebound toward the other adjacent court. As a result of actually playing a tennis in one of a plurality of tennis courts of a tennis court field whose peripheral wall is mounted with the surface member according to the invention, it was confirmed that such trouble as running of the ball in the adjacent court was reduced by half, as compared with a tennis court field whose peripheral wall is not mounted with the surface member.

Although the surface member according to the invention is mounted on a surface of concrete wall in the foregoing embodiment, the surface member can be also preferably mounted on a surface of wooden wall, block wall, etc., as a matter of course. In addition, it is preferable from the economical point of view that the surface member according to the invention be mounted at a position between one section and and the other of the peripheral wall respectively located rearward of back lines of tennis courts adjacent to each other, but it is also satisfactory that the surface members are mounted on all over the peripheral wall of the tennis court field.

I claim:

1. A surface unit for controllably repelling a tennis ball in a rebound-reducing manner, supported at a substantially vertical wall at the periphery of a tennis court, comprising:

a plurality of elongate ball-repelling members comprising a ball rebound-reducing material, said repelling members each being triangular in cross-section and attached to extend vertically in parallel on said surface of said peripheral wall, each member having a base attached to said wall and a vertical ridge line formed at the intersection of two planar ball-repelling sides extending from said base; and said repelling members further being attached to said wall such that the distance between said ridge lines of adjacent repelling members are equal to the diameter of a tennis ball.

2. A surface unit according to claim 1, wherein:

said planar ball-repelling sides are of equal width and intersect substantially orthogonally.

3. A surface unit according to claim 2, wherein:

the width of each repelling member at its base is equal to or not less than the diameter of a tennis ball.

4. A surface unit according to claim 2, wherein:

the repelling members comprise a spongy material.

5. A surface unit according to claim 4, wherein:

said spongy material is covered with leather.

6. A surface unit according to claim 1 wherein:

the width of each repelling member at its base is equal to the diameter of a tennis ball.

7. A surface unit according to claim 6, wherein:

the repelling members comprise a spongy material.

8. A surface unit according to claim 7, wherein:

said spongy material is covered with leather.

9. A surface unit according to claim 1, wherein:

the repelling members comprise a spongy material.

10. A surface unit according to any of claim 4, wherein:

said spongy material is covered with leather.

* * * * *